United States Patent [19]

Magee et al.

[11] 4,437,816

[45] Mar. 20, 1984

[54] VARIABLE VOLUME POSITIVE DISPLACEMENT ROTARY PUMP

[75] Inventors: Dennis A. Magee, Marshalltown; Charles E. McCubbin, Melbourne, both of Iowa

[73] Assignee: Dunham-Bush, Inc., West Hartford, Conn.

[21] Appl. No.: 132,712

[22] Filed: Mar. 21, 1980

[51] Int. Cl.[3] ..... F04B 19/02

[52] U.S. Cl. ..... 417/465

[58] Field of Search ..... 417/462, 463, 464, 465, 417/269; 91/493, 494, 495; 277/93 R, 92

[56] References Cited

U.S. PATENT DOCUMENTS

| | | | |
|---|---|---|---|
| 1,729,764 | 10/1929 | Dinesen | 417/462 |
| 2,248,452 | 7/1941 | Erickson | 91/493 |
| 2,277,991 | 3/1942 | Leonard | 417/462 |
| 2,510,903 | 6/1950 | Quiroz | 417/462 |
| 2,551,430 | 5/1951 | Estey | 91/493 |
| 2,977,891 | 4/1961 | Bishop | 91/494 |
| 3,093,381 | 6/1963 | Schulz | 277/93 R |
| 4,264,283 | 4/1981 | Gaffney | 417/269 |

*Primary Examiner*—Carlton R. Croyle
*Assistant Examiner*—Jeffrey A. Simenauer
*Attorney, Agent, or Firm*—Sughrue, Mion, Zinn, Macpeak & Seas

[57] ABSTRACT

A tubular cylinder block is mounted for rotation about its axis within a cylindrical bore of a pump housing. The pump housing has circumferentially spaced inlet and outlet ports opening radially to the bore. Right angle intersecting diametric passages extend through the cylinder block and are alignable with the inlet and outlet ports during rotation of the drive block, the diametric passages being square in cross-section, and piston members of corresponding square transverse cross-section are slidably positioned within respective diametric passages with the piston members bearing square slots within side faces thereof intermediate of their ends facing axially. A square drive block is carried commonly within the piston member slot whose axis of rotation is adjusted eccentrically relative to the axis of rotation of the cylinder block. Cylinder block internal peripheral grooves separated by lands control fluid passage via the piston formed cavities between the inlet and outlet ports.

4 Claims, 5 Drawing Figures

FIG. 1
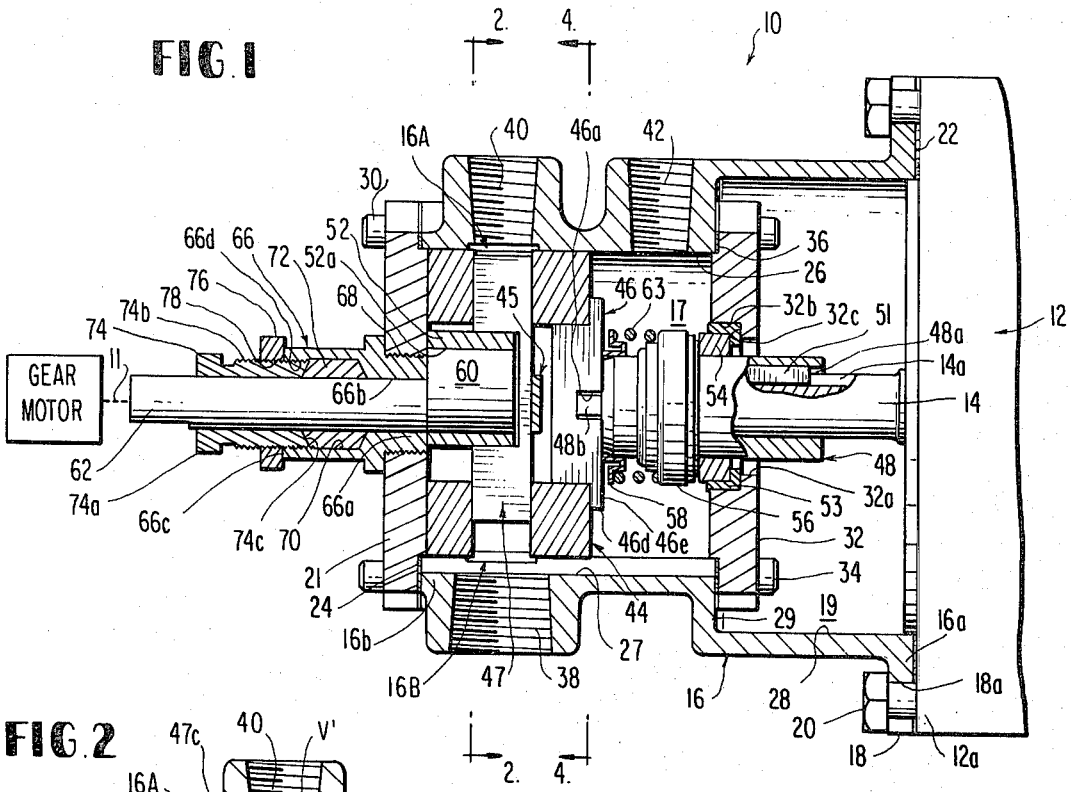
FIG. 2
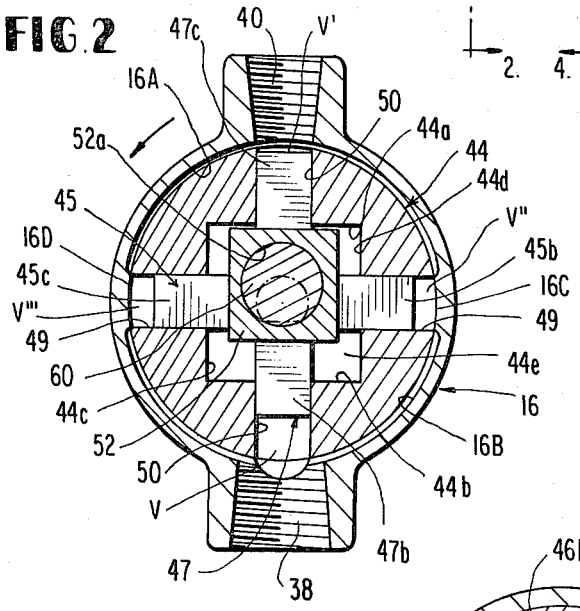
FIG. 3
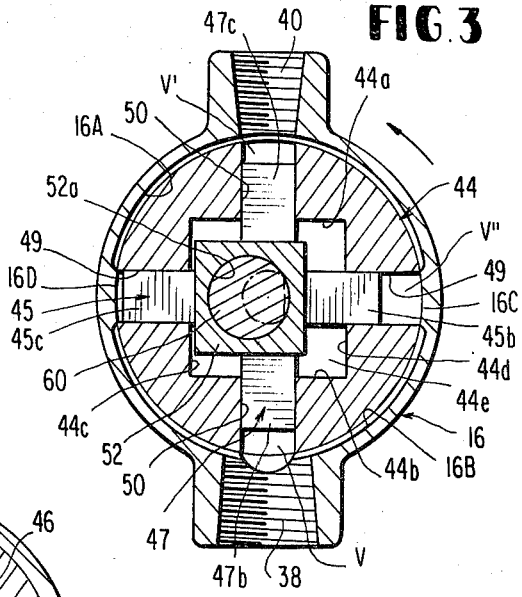
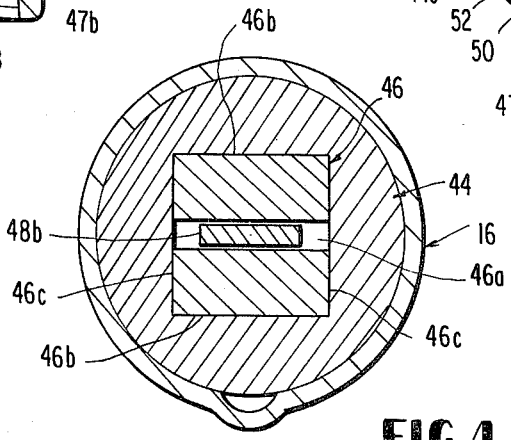
FIG. 4

VARIABLE VOLUME POSITIVE DISPLACEMENT ROTARY PUMP

FIELD OF THE INVENTION

This invention relates to positive displacement rotary pumps, and more particularly, to such rotary pumps whose volume or capacity may be readily adjusted.

Positive displacement rotary pumps have long been employed for pumping oil and light incompressible fluids and in which a rotary member is mounted eccentric to the axis of the cylinder within which it is placed, and wherein radial, sliding blades are borne within the rotary member, and wherein working chambers as defined by the cylindrical bore of the fixed housing or casing, the rotary member rotating about its axis but eccentric with respect to the axis of the bore and the sliding vanes decrease in volume between circumferentially spaced inlet and outlet port locations, opening radially of the interior of the cylindrical bore housing these members. While such pumps are quite capable in operation, they have certain deficiencies. The limited contact area between the moving elements and the fixed elements of the pump result in high wear, noise and fatigue of these parts.

SUMMARY OF THE INVENTION

The present invention is directed to an improved variable volume rotary pump which comprises a pump housing having a cylindrical bore. An annular cylinder block having a diameter on the order of the pump housing bore is mounted concentrically within the bore for rotation about its axis. Circumferentially spaced inlet and outlet ports are provided within the housing which are in radial plane alignment. At least one diametric passage extends through the cylinder block at right angles to its axis of rotation, and piston members in the area of crossing each bear a square slot within their side faces facing axially of the cylinder block. These form connected rectangular pistons on each side of the square slot for each respective piston member. A square drive block is carried jointly within the piston member slots. Means are provided for adjusting eccentrically, the drive block axis relative to the axis of the cylinder block. Motor means are provided for driving the cylinder block about its axis of rotation, whereby the square pistons slide within the diameteric passages during rotation, but the pistons are prevented from rotation and contact between themselves, and wherein the increase in contact area between the pistons and the cylinder block tends to reduce wear, noise and fatigue of the pistons. Cylinder block internal peripheral grooves separated by lands control fluid passage via the piston formed cavities between the inlet and outlet ports.

Preferably, an electric drive motor has a motor drive shaft projecting from one end thereof which engages the cylinder block on one side thereof. An adjustment shaft may be coaxially fixedly mounted on the side of the cylinder block opposite that connected to the motor drive shaft. The eccentric adjustment shaft bears a cylinder or eccentric on one end thereof which is eccentric with respect to the axis of the eccentric adjustment shaft and which is carried within a circular bore of the drive block shaft such that the drive block rotates on its circular bore. A cylindrical stuffing box bears the eccentric adjustment shaft, the eccentric adjustment shaft slidably supporting a gland nut having threaded to the exterior thereof, a lock nut which, in turn, threadably abuts the end of the stuffing box. The gland nut has an end received within the stuffing box and which longitudinally bears on packing such that, backing off the gland nut, permits seal adjustment of the shaft. The gland nut is then tightened to vary the seal, whereupon, the lock nut is tightened against the end of the stuffing box cylinder to set the seal.

The pump housing may comprise a cylindrical member. The inlet and outlet ports may be diametrically opposite each other, and the cylindrical housing bore includes peripheral recesses between the inlet and outlet ports which are closed off intermediate the inlet and outlet ports by a land. Further, a longitudinal recess within the bore extends from the inlet port to a point longitudinally beyond one end of the cylinder block. The casing further comprises a bypass outlet port within the casing in fluid communication with the longitudinal recess such that when the pump is not operating, the bypass outlet port functions to maintain the pump at constant operating temperature. The cylinder block may be provided with an axial opening of rectangular transverse cross-section and the motor shaft may carry on the end of the shaft facing the cylinder block a rectangular drive plate operatively coupled to the motor shaft for rotation therewith. The drive plate has a portion projecting within the drive block rectangular opening corresponding in configuration and size to such opening whereby the rectangular drive plate, in turn, drives the cylinder block about its axis during rotation of the motor shaft. Preferably, a damper motor is connected by means of suitable linkage to the eccentric adjustment shaft and the eccentric is rotated by the shaft automatically to provide the required input.

BRIEF DESCRIPTION OF THE DRAWINGS

FIG. 1 is a vertical sectional view of an electric drive motor and variable volume rotary pump forming a preferred embodiment of the present invention in vertical section and partially broken away.

FIG. 2 is a vertical sectional view of a portion of the pump taken about line 2—2 of FIG. 1.

FIG. 3 is a vertical sectional view of the portion of the pump identical to that of FIG. 2 with the eccentric adjustment shaft rotated 90° to that shown in FIG. 2.

FIG. 4 is a vertical sectional view of a portion of the pump assembly of FIG. 1 taken about line 4—4.

DESCRIPTION OF THE PREFERRED EMBODIMENT

Figure 5:
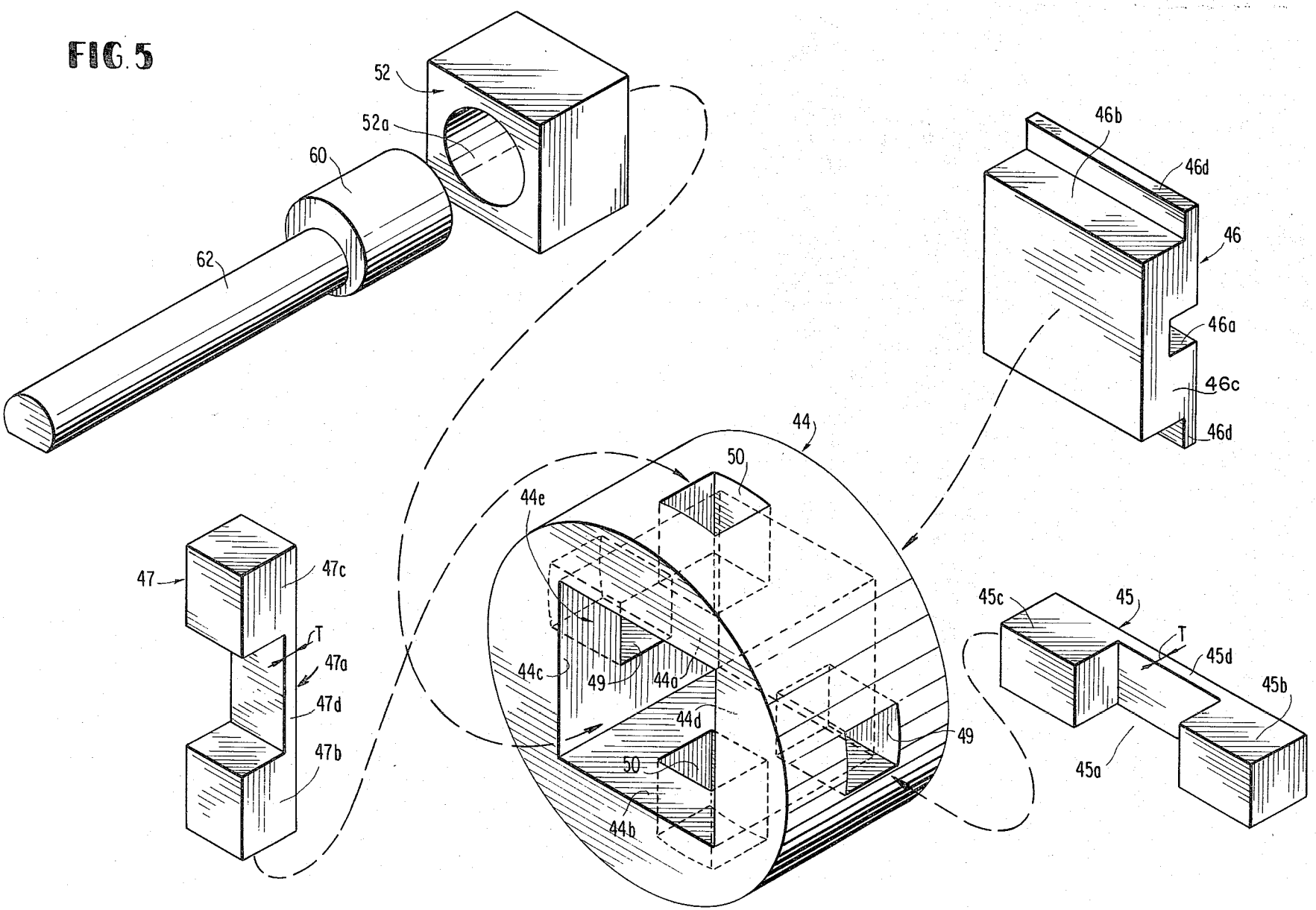
FIG. 5 is an exploded, perspective view of the principal components of the variable volume rotary pump of FIG. 1, showing the nature of the assembly of the components.

Referring to the drawings, there is shown a variable volume positive displacement rotary pump, indicated generally at 10, the pump 10 being mounted to the end of a drive motor 12 and being coupled mechanically to the drive motor shaft 14 such that the pump 10 operates upon energization of the electric drive motor 12. The pump 10 comprises a cylindrical pump housing indicated generally at 16 which terminates at one end 16*a* in a radially outwardly directed flange 18 through which, at spaced circumferential positions, extend holes or openings 18*a* which receive bolts 20 for locking the pump housing to the end of a motor housing 12*a* of the motor 12. A gasket 22 is interposed between the flange 18 of the pump housing 16 and the end of the motor housing 12*a*. The cylindrical housing 16 is open at both ends with the end 16*b*, opposite that 16*a* bearing the flange 18, having mounted thereto, an end plate 21. End plate 21 is circular in form and is mounted to the cylindrical pump housing 16 by means of a plurality of cap screws 30 with the end plate being sealed to the pump housing 16 by way of gasket 24. The pump housing 16 may be of cast construction or, alternatively, it may be machined so as to include a cylindrical bore 26 and a counterbore 28 constituting an enlarged diameter cavity on the right side of the pump housing, as seen in FIG. 1. Cast, machined, or otherwise formed within the cylindrical pump housing 16, are diametrically opposed inlet and outlet ports as at 38, 40, respectively, the ports 38 and 40 being in generally transverse planar alignment and displaced longitudinally relative to the third port 42 constituting a bypass outlet port for the pump. The port 42 is in general longitudinal alignment with the outlet port 40 and opens to the bore 26 as does the inlet and outlet ports 38 and 40, respectively. Rotatably mounted within the housing bore 26 is annular cylinder block 44. Block 44 and the other components of the pump are preferably formed of metal. The diameter of the cylinder block 44 is slightly less than the diameter of bore 26 so as to sealably fit within this bore and thus being supported for rotation about its axis coaxial with the bore 26. Bore 26 and counterbore 28 form a radial shoulder as at 29, and bore 26 at this end is closed off by way of a back plate 32. Back plate 32 is annular in form and is mounted to the pump housing 16 by way of a plurality of circumferentially spaced cap screws 34, the back plate 32 being sealed relative to bore 26 by way of annular sealing gasket 36.

The annular back plate 32 is provided with a bore at 32*a* and a counterbore at 32*b* through which the motor drive shaft 14 projects. The motor drive shaft 14 is provided with a longitudinal keyway 14*a* which is rectangular in cross-section and within which fits a rectangular striplike key 51. Mounted to the motor shaft 14 is a cylindrical drive coupler 48 which bears a rectangular recess longitudinally within the same, as at 48*a* which is in alignment with the keyway 14*a* within motor shaft 14. The key 51 is inserted within aligned slots 14*a* and 48*a* to lock the drive coupler 48, and the drive coupler 48 is forced to rotate with shaft 14 when the motor 12 is energized. The drive coupler 48 is cylindrical in form and terminates at its end opposite motor 12 in an axial projection 48*b* of rectangular cross-section which extends diametrically across the end of drive coupler 48. The cylinder block 44 is provided with a rectangular and, preferably, as illustrated, square opening 44*e* formed by opposed walls 44*a* and 44*b* and right angle opposed walls 44*c* and 44*d*, respectively. Mounted within the right end of the square opening 44*e* of the cylinder block 44 is a squared off drive plate 46 having a square projection portion formed by opposed faces 46*b* and right angle opposed faces 46*c*, the opposed portion of this member being extended by way of flanges as at 46*d* which act as axial stops and prevent further projection of the drive plate within the square hole 44*e* of the drive block. Centrally within the face 46*e* of the drive plate, is a transverse, rectangular slot 46*a* within which is fitted the rectangular cross-sectional axial projection 48*b* of the drive coupler 48.

As may be appreciated, when shaft 14 rotates, the drive coupler 48 which is keyed thereto, causes the projection 48*b* of the drive coupler 48 fitted to slot 46*a* of the drive plate 46, to drive plate 46 about the axis of shaft 14. Since the drive plate projection 46*b* is fitted to the square opening 44*e* of the cylinder block 44, the cylinder block 44 necessarily rotates about its axis coaxially within the pump housing bore 26.

The cylinder block 44 is further provided with diametrically extending and right angle intersecting passages 49 and 50. In the position of the cylinder block 44, as shown in the drawings, passage 49 is horizontal and passage 50 is vertical, the passages opening up to the square hole 44*e* which extends axially within the cylinder block 44 and at right angles to passages 49 and 50. Slidably positioned within passages 49 and 50 are respectively pistons or piston members 45 and 47. Both of these piston members take the form of rectangular blocks having square transverse cross-sections, dimensioned slightly less than and being slidably fitted within respective diametric passages 49 and 50. Passages 49 and 50 are slightly axially offset. Further, each of the piston members is slotted intermediate of its ends to form rectangular slots as at 45*a* for piston 45 and as at 47*a* for piston 47. This forms for piston member 45, pistons 45*b*, 45*c*, which are connected at 45*d*, and for piston member 47, pistons 47*c* and 47*b* at respective ends of piston member 47 connected at 47*d*. The rectangular slots as at 45*a* for piston member 45 and 47*a* for piston member 47 open to the square hole 44*e* within the cylindrical drive block 44 and the piston member slots 45*a* and 47*a* face the end of the pump remote from the electric drive motor 14. The slots 45*a* and 47*a* are dimensioned so as to closely receive the piston members. It should be noted that the square cross-section diametric passages 49 and 50 are slightly axially offset from each other the distance of the thickness T of the portions 45*d*, 47*d* connecting the piston members 45 and 47. In general, the plane of rotation of the piston members 45 and 47 within the cylindrical drive block 44 correspond with the transverse or radial plane extending through the axes of the diametrically opposed inlet and outlet ports 38 and 40, respectively. The square drive block 52 may be cubic in form with four equally dimensioned right angle sides which are dimensioned to the slots 45*a* and 47*a* of the piston members 45 and 47 and are closely received within these slots when the piston members 45 and 47 are slidably mounted within the diametric passages 49 and 50, respectively, of block 52.

Drive block 52 bears an axial bore 52*a* which receives a cylinder or eccentric 60 having a diameter essentially equal to that of or slightly smaller than the bore 52*a* of the drive block 52 within which the eccentric 60 is positioned. In turn, the eccentric 60 is fixed to one end of an eccentric adjustment shaft 62, the eccentric or cylinder 60 being eccentrically mounted with respect to the axis of shaft 62. When the shaft 62 rotates, the eccentric 60 rotates eccentrically about the axis of shaft 62. Thus, the drive block 52 axis of rotation shifts in an eccentric manner. The eccentric adjustment shaft 62 projects outwardly of the pump housing end plate 21. The end plate 21 is provided with a tapped and threaded bore 54 which threadably receives one end 66*a* of a cylindrical stuffing box member indicated generally at 66. The stuffing box member portion 66*a* is threaded on its exterior as at 68, and is threadably locked to the end plate 21. The stuffing box member 66 is provided with a bore 66*b*, and bears an annular internal recess 70, within which is carried stuffing box packing 72. Also slidably mounted on the shaft 62 is a cylindrical gland nut indicated generally at 74 provided with a hex end 74*a* and being threaded over the major portion of its outer periphery as at 74*b*. End 74*c* of the gland nut 74 presses against the end of the packing 72. The stuffing box member 66 is threaded as at 66*d* to threadably engage the threaded portion 74*b* of the gland nut 74. In turn, the gland nut threaded portion 74*b* carries a lock nut 76 which is threaded internally as at 78 and which, when rotated, bears against the end 66*c* of the stuffing box member to lock the gland nut 74*a* in an axial position compressing the packing 72, thereby insuring that a fluid seal exists for eccentric 60 regardless of its angular eccentric position about shaft 62 axis, which defines the eccentric position of the piston drive block 52 rotating on eccentric 60.

It may be further ascertained that a positive displacement pumping action occurs due to the cooperative nature between the sliding piston members and the pump housing which bears upper and lower cooperating internal peripheral grooves as at 16A and 16B, respectively, which intersect the inlet and outlet ports 38, 40, respectively, and which are separated by non-grooved portions defining lands 16C and 16D, which in the illustrated case are diametrically opposite and at right angles to inlet and outlet ports 38, 40. While the upper groove 16A communicates fully over its arcuate extent with outlet port 40, and while the lower groove 16B is open throughout its arcuate extent with inlet port 38, communication is effected by way of the cavities or volumes formed between the reciprocating piston members and the diametric passages 49 and 50, within which the piston member slides.

Under the circumstances as seen in FIG. 3, a fluid entering the inlet port 38 fills the portion of the diametric passage 50 at the end of piston member 47*b* when that passage is aligned with the port 38 at that moment. Piston member 47*b* and its cylinder block 44 defines a pumping chamber V of given volume. As the cylinder block 44 rotates about its axis, in the direction of the arrow, FIG. 3, the drive block 52 is forced to rotate about the axis of the eccentric cylinder 60 and causes the piston member 47 to slide within diametric passage 50 (as does piston 45 within passage 49). In the instant case, the piston 47*b* when moving, due to rotation of cylinder block 44, from its position shown in FIG. 3 to a position just prior to that occupied by piston 45*b*, causes an increase in the volume V to a much increased value V″ prior to opening the chamber to the outlet port 40 for discharge. The intermediate volume V″ is shown at that instant for piston 45*b*, which is cut off from the inlet and outlet ports by land 16C, the reciprocating action of the pistons changing the volume of the working chambers as defined by the pistons and the diametric passages 49 and 50 within cylinder block 44 which bear these passages.

As can be appreciated, subsequent to the volume V″ being cut off to the inlet port 38 via the lower groove 16B, it opens to the outlet port via the upper groove 16A and its volume diminishes to volume V′. FIG. 3, therefore, shows the eccentric to the left and therefore the maximum output or maximum flow conditions for the positive displacement pump. As may be further appreciated, during continued counterclockwise rotation, the piston member in moving from the outlet port 40 back towards the inlet port 38 passes by land 16D. At this point, with the eccentric positioned as shown in FIG. 3, the piston member as evidenced at 45*c* will be extended the maximum towards the outside, that is, radially outwardly nearly touching the section of the housing between the circular grooves or passages 16A and 16B at land 16D. However, as the cylinder 44 continues to rotate, the cavity opens within cylinder block diametric passage bearing the piston member and communicates with the lower groove 16B, allowing oil to flow through the inlet and passage or groove 16B for reception into the cavity provided by the diametric passage bearing piston member. As may be appreciated, it is not necessary that the inlet and outlet ports 38 and 40 be diametrically opposite each other, and in fact in some circumstances, this would not be desirable. It is only necessary that the ports connect to their respective grooves or passages as at 16A, 16B, and that they be separated by way of lands as at 16C, 16D.

As may be appreciated by viewing FIG. 2, particularly in conjunction with FIGS. 1 and 5, the eccentric adjustment shaft 62 is rotated by an appropriate mechanism, whereupon, the axis of the eccentric 60 may be shifted 90° from that shown in FIG. 3, with shaft 62 rotating 90° about its axis and causing a corresponding eccentric shift for the piston drive block 52. This will change the pump 10 from its maximum capacity condition, as illustrated in FIG. 3, to zero capacity or completely unloaded condition, as seen in FIG. 2. In this case, the working chamber volume V″ in FIG. 3, 90° to the bottom opening to the inlet 38 is equal to the volume V‴ diametrically opposite thereto, that volume having changed from intermediate values as at V and V′ in this figure. While not shown, further rotation of the eccentric 60 in the direction of arrow 61, FIG. 3, will permit the pump to be reversely operated, that is, outlet 40 can become an inlet and inlet 38 can become the outlet 40 for the pump. However, this will affect specific arrangements made for bypassing the flow under circumstances where the pump is not permitted to positively drive fluid from inlet port 38 to outlet port 40.

In this respect, the pump housing 16 at the bore 26 is provided with an annular elongated groove or bypass channel 27 which extends the length of the bore 26, intersecting inlet port 38 at its center and extending well past the side of the cylinder block 44 facing the back plate 32. The portion of the bore 26 not occupied by the cylinder block 44 forms a cavity 17, not only within which is located the drive coupler 48 coupling motor drive shaft 14 to the cylinder block 44 via drive plate 46, but also fluid connecting the bypass channel 27 and thus the inlet port 38 to the bypass outlet port 42. This allows flow through the pump via the inlet port 38 and the bypass outlet port 42 when the pump is not operating, to maintain the pump at constant operating temperature.

In the illustrated embodiment of the invention, a gear motor which is schematically shown in FIG. 1, is connected mechanically as shown in dotted line fashion at 11 to shaft 62 to match oil flow to demand, the eccentric being rotated by the shaft automatically to provide the input required to the pump.

A further aspect of the present invention is the nature in which the drive plate axial projection is spring biased into the square opening 44*e* within the cylinder block 44 and the cylinder block 44 in turn is forced against the end plate 21 while maintaining a mechanical seal between the driven cylindrical drive coupler 48 and the back plate 32 at the opening through which both shaft 14 and the drive coupler 48 project into pump housing cavity 17.

An annular ring 58 is mounted to the cylindrical drive coupler 48 adjacent drive plate 46 against which one end of a biasing compression coil spring 63 abuts while the opposite end of the coil spring 63 abuts against a radial shoulder of a collar 56 which slides upon the cylindrical drive coupler 48 and which, in turn, presses a ring seal 54 of rectangular radial cross-section against a fixed mechanical seal 53. Seal 53 is of L-shaped radial cross-section and is borne within counterbore 32*b* to abut a shoulder 32*c* defined by bores 32*a* and 32*b* within the back plate 32. Thus, the compression coil spring 63 performs one function in axially biasing the pump cylinder block 44 to the left, maintaining the piston members in contact with the drive block 52 and the diametric passages 48 and 50 properly aligned with the normal flow plane for the fluid being pumped as defined by the aligned axes of the inlet port 38 and outlet port 40. Spring 63 further biases the seal member 52 to the right, sealing off chamber 17 from a chamber 19 on the right side of back plate 32.

While the invention has been particularly shown and described with reference to a preferred embodiment thereof, it will be understood by those skilled in the art that various changes in form and details may be made therein without departing from the spirit and scope of the invention.

What is claimed is:

1. An improved variable volume rotary pump comprising:

a pump housing having a cylindrical bore, a cylinder block having a diameter on the order of said pump housing bore and being mounted concentrically within said bore for rotation about its axis, circumferentially spaced inlet and outlet ports within said housing opening radially to said bore, said cylinder block being provided with an axial opening, at least one diametric passage of rectangular cross-section extending through said cylinder block, a piston member of corresponding rectangular transverse cross-section slidably and sealably positioned within said diametric passage and having a cross-section corresponding to but being slightly smaller than that of said diametric passage, said piston member bearing a square slot within a side face thereof intermediate of its ends and facing axially towards one end of said cylinder block and forming two connected rectangular cross-section pistons on respective sides of said rectangular slot, a square drive block carried within said piston member slot, means for mounting said square drive block within said cylinder block for rotation eccentrically relative to the axis of said drive block, motor means for driving said cylinder block about its axis of rotation, and annular grooves carried by said pump housing within said cylindrical bore opening respectively to said inlet and said outlet port but being separated from each other by lands such that said at least one diametric passage of said cylinder block opens alternately to said grooves during continuous rotation of said cylinder block;

whereby, said rectangular cross-section pistons reciprocate within said cylinder block at least one diametric passage to pump fluid from said inlet port to said outlet port with said assembly preventing piston rotation and contact between pistons, with increased contact area between said pistons and said drive block to reduce wear, noise and fatigue of said pistons, and wherein said motor drive shaft bears a cylindrical drive coupling rotatable therewith, said drive coupling terminating at the end remote from said electric drive motor in a rectangular cross-section axial projection, and a drive plate comprising a rectangular cross-section slot on the side opposite that bearing the square projection received within the axial opening of square transverse cross-section of said cylindrical block, and said pump further comprising transverse end plates for closing off said pump housing cylindrical bore, one annular seal member carried by said cylindrical drive coupling on the outer periphery thereof and bearing at one end on a second annular seal member mounted to the end plate through which said drive motor shaft projects, and a compression coil spring concentrically surrounding the cylindrical drive coupling and interposed between said drive plate and said one annular seal member and biasing said annular seal member carried by the cylindrical drive coupling against the annular seal member fixed to said one end plate and for pressing the square face of the drive plate into the square opening within the cylindrical block to maintain driving engagement between said cylindrical drive coupling and the cylindrical cylinder block and for maintaining said at least one diametric passage in alignment with the inlet and outlet ports of said pump housing during rotation of said cylinder block about its axis towards said pump housing during rotation of the cylinder block about its axis.

2. The improved variable volume rotary pump as claimed in claim 1, wherein said cylinder block axial opening is of square cross-section, said at least one diametric passage comprises a pair of right angle intersecting diametric passages which are axially offset from each other relative to the axis of said cylinder block, and wherein piston members for each of said diametric passages bear square slots which contact, respectively, opposed sides of said square drive block.

3. The improved variable volume rotary pump as claimed in claim 2, wherein said motor means comprises an electrical motor coupled to one end of said pump housing and bearing an axially projecting motor drive shaft coaxial with the axis of the pump housing cylindrical bore and wherein said drive plate includes a square projection at one end in operative engagement with said electric motor drive shaft and being received within said axial opening of square transverse cross-section within said cylinder block to rotate said cylinder block about its axis.

4. The improved variable volume rotary pump as claimed in claim 1, wherein said pump further comprises a stuffing box member concentric of said eccentric adjustment shaft and being fixedly mounted at one end to the other one of said end plates, and wherein a gland nut is slidably mounted on said eccentric adjustment shaft and threaded to said stuffing box member and wherein packing surrounds said shaft, between said gland nut and said stuffing box member such that rotation of said gland nut tends to compress said packing, and a lock nut threadably carried by said gland nut which bears at one end against said stuffing box member to lock said gland nut at a given angular position to set the sealing pressure of the stuffing box member.

* * * * *